US010711955B2

(12) United States Patent
Mullen

(10) Patent No.: US 10,711,955 B2
(45) Date of Patent: Jul. 14, 2020

(54) RUBBERIZED LIGHT HOUSING AND ADAPTOR

(71) Applicant: Nate Mullen, Valley Center, CA (US)

(72) Inventor: Nate Mullen, Valley Center, CA (US)

( * ) Notice: Subject to any disclaimer, the term of this patent is extended or adjusted under 35 U.S.C. 154(b) by 0 days.

(21) Appl. No.: 16/221,196

(22) Filed: Dec. 14, 2018

(65) Prior Publication Data

US 2019/0186701 A1 Jun. 20, 2019

Related U.S. Application Data

(60) Provisional application No. 62/607,235, filed on Dec. 18, 2017.

(51) Int. Cl.

| | |
|---|---|
| ***F21S 8/02*** | (2006.01) |
| ***F21S 4/20*** | (2016.01) |
| ***F21V 31/00*** | (2006.01) |
| ***F21V 5/04*** | (2006.01) |
| ***F21V 15/01*** | (2006.01) |
| ***F21V 21/04*** | (2006.01) |
| *F21V 11/06* | (2006.01) |
| *F21V 11/02* | (2006.01) |

(52) U.S. Cl.

CPC ..... *F21S 4/20* (2016.01); *F21V 5/04* (2013.01); *F21V 15/012* (2013.01); *F21V 21/04* (2013.01); *F21V 31/005* (2013.01); *F21S 8/026* (2013.01); *F21V 11/02* (2013.01); *F21V 11/06* (2013.01)

(58) Field of Classification Search

CPC ..... F21V 31/00; F21V 31/005; F21V 15/012; F21V 21/04; F21V 11/02; F21V 11/06; F21V 19/005; F21V 25/00; F21S 4/20; F21S 8/02; F21S 8/026; F21S 45/50

See application file for complete search history.

(56) References Cited

U.S. PATENT DOCUMENTS

| | | | | |
|---|---|---|---|---|
| 5,036,248 | A * | 7/1991 | McEwan | G09F 9/33 362/812 |
| 5,097,566 | A * | 3/1992 | Decker | B25F 5/006 30/276 |
| 5,633,629 | A * | 5/1997 | Hochstein | G08C 23/04 362/800 |
| 5,678,921 | A * | 10/1997 | Kish | F21L 4/005 362/188 |
| 6,053,623 | A | 4/2000 | Jones et al. | |
| D436,208 | S | 1/2001 | De'Armond | |
| 6,379,025 | B1 * | 4/2002 | Mateescu | F21S 8/00 362/293 |

(Continued)

*Primary Examiner* — Y M. Quach Lee

(74) *Attorney, Agent, or Firm* — Kelly & Kelley, LLP

(57) ABSTRACT

A resiliently flexible, rubberized light housing for sealingly enclosing and protecting a light bulb or fixture against moisture and other intrusion. The housing has an elongated, generally tubular body with an open first end and a closed second end. The open first end may receive and retain a bulb or fixture that has an exposed bulb or element or is environmentally sealed. If the bulb or fixture is sealed, then the same may hermetically seal the open first end. If the bulb or fixture is not sealed, then a lens may be included to hermetically seal the open first end with the bulb or fixture in the interior. Electrical wires for connection to the bulb or fixture may be passed through a sealing port on the closed send end. The plurality of ribs are configured for friction contact with the inside of a lighting can.

18 Claims, 10 Drawing Sheets

(56) References Cited

U.S. PATENT DOCUMENTS

| | | | | |
|---|---|---|---|---|
| D567,424 | S | 4/2008 | St-Pierre et al. | |
| D652,156 | S | 1/2012 | Li et al. | |
| 2007/0097675 | A1* | 5/2007 | Koren | F21V 23/02 362/158 |
| 2007/0247837 | A1 | 10/2007 | Julia Vilarrasa | |
| 2010/0246195 | A1* | 9/2010 | Muller | F21S 8/00 362/375 |

* cited by examiner

RUBBERIZED LIGHT HOUSING AND ADAPTOR

RELATED APPLICATION

This application claims the benefit of U.S. Provisional Application No. 62/607,235, filed on Dec. 18, 2017.

BACKGROUND OF THE INVENTION

The present invention is directed to a light housing and adaptor for using light bulbs with well lights and similar fixtures having circular cans. More particularly, the rubberized light housing is for use with MR-16 or similar parabolic light bulbs of various sizes.

Prior art devices for mounting light bulbs in well lights or similar structures tend to expose the light bulb and electrical connections to environmental factors. In addition, the light bulbs are often much smaller than the cans or other housing structures found in such fixtures. Such bulbs are often retained using rigid metal structures that a forced into place or permanently attached to the housing. Such prior art devices are difficult to work with, repair, and/or replace.

Accordingly, there is a need for a light housing that makes it easier to install light bulbs in well lights and similar structures, as well as, provides protection from environmental hazards like water or moisture. The present invention fulfills these needs and provides other related advantages.

SUMMARY OF THE INVENTION

The present invention is directed to a light housing, in particular, a rubberized light housing having an elongated body with a generally tubular shape. The elongated body has an open first end and closed second end, where the first end is configured to receive and retain a light bulb proximate thereto. A sealing port is included in the second end. The sealing port is configured to hermetically seal against electrical wires passed into an interior of the elongated body. A plurality of ribs is uniformly spaced around a perimeter of the first end of the elongated body.

The first end may sealingly receive and retain the light bulb so as to hermetically seal the interior of the elongated body. Alternatively, a lens may be sealingly disposed in a lens channel proximate the open first end of the elongated body. The lens may hermetically seal the interior of the elongated body. A support rib may be disposed on the second end of the elongated body, the support rib configured for receiving a hook or other mounting means to retain the light housing.

Each of the plurality of ribs is resiliently flexible and configured for friction contact with an interior of a lighting can. At least one of the plurality of ribs is capable of being cut so as to reduce a span of the plurality of ribs. The elongated body, sealing port, and plurality of ribs are preferably all manufactured from a rubber material.

The light housing may also include an adaptor ring having a plurality of larger ribs uniformly spaced around a perimeter thereof. The adaptor ring is configured for concentric engagement with the plurality of ribs on the first end of the elongated body. The adaptor ring is configured to enlarge a span of the plurality of ribs. The adaptor ring is also resiliently flexible and configured for friction contact with an interior of a larger lighting can.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 3:
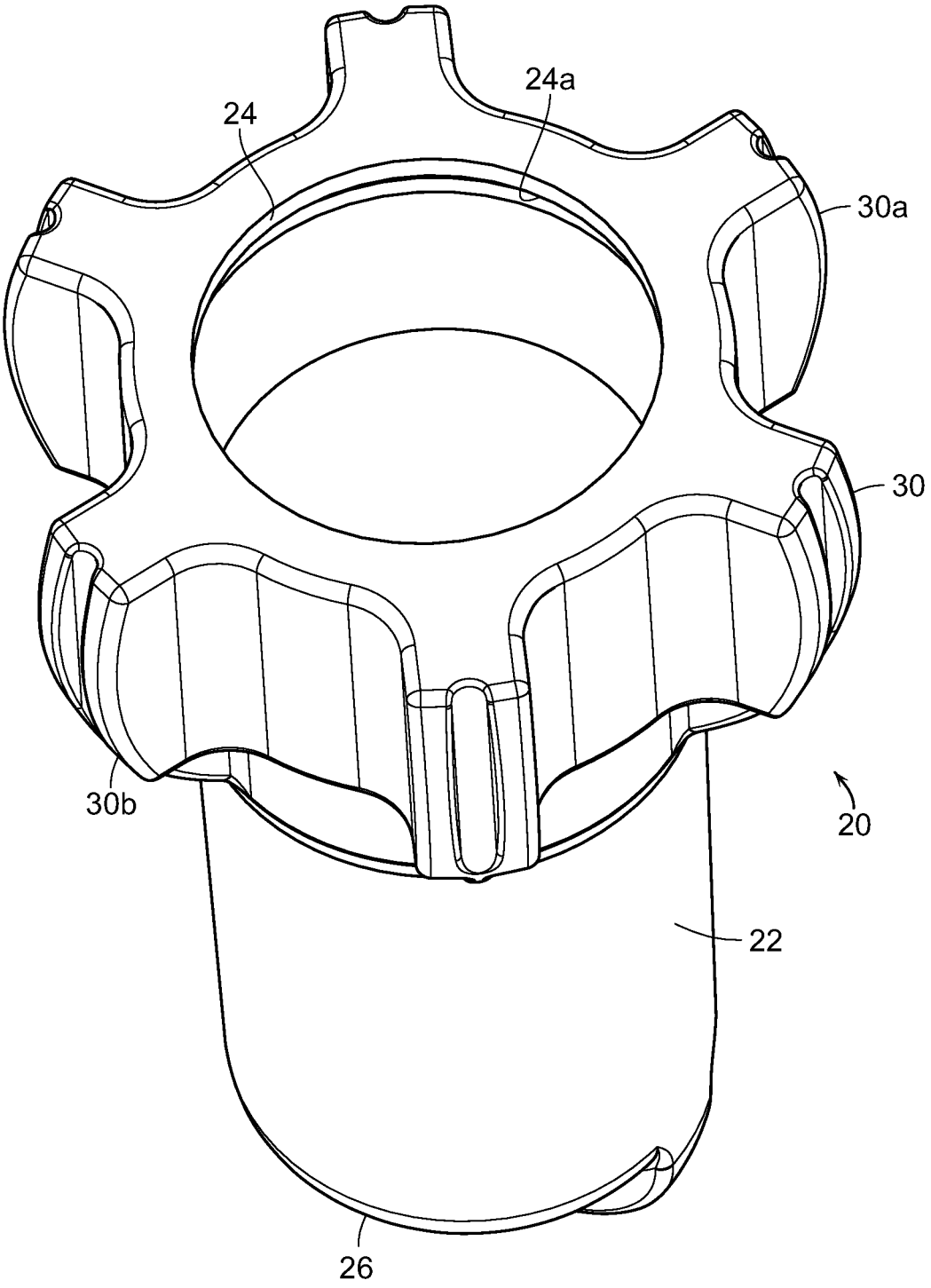
FIG. 3 is a perspective view of the inventive rubberized light housing.
Figure 4:
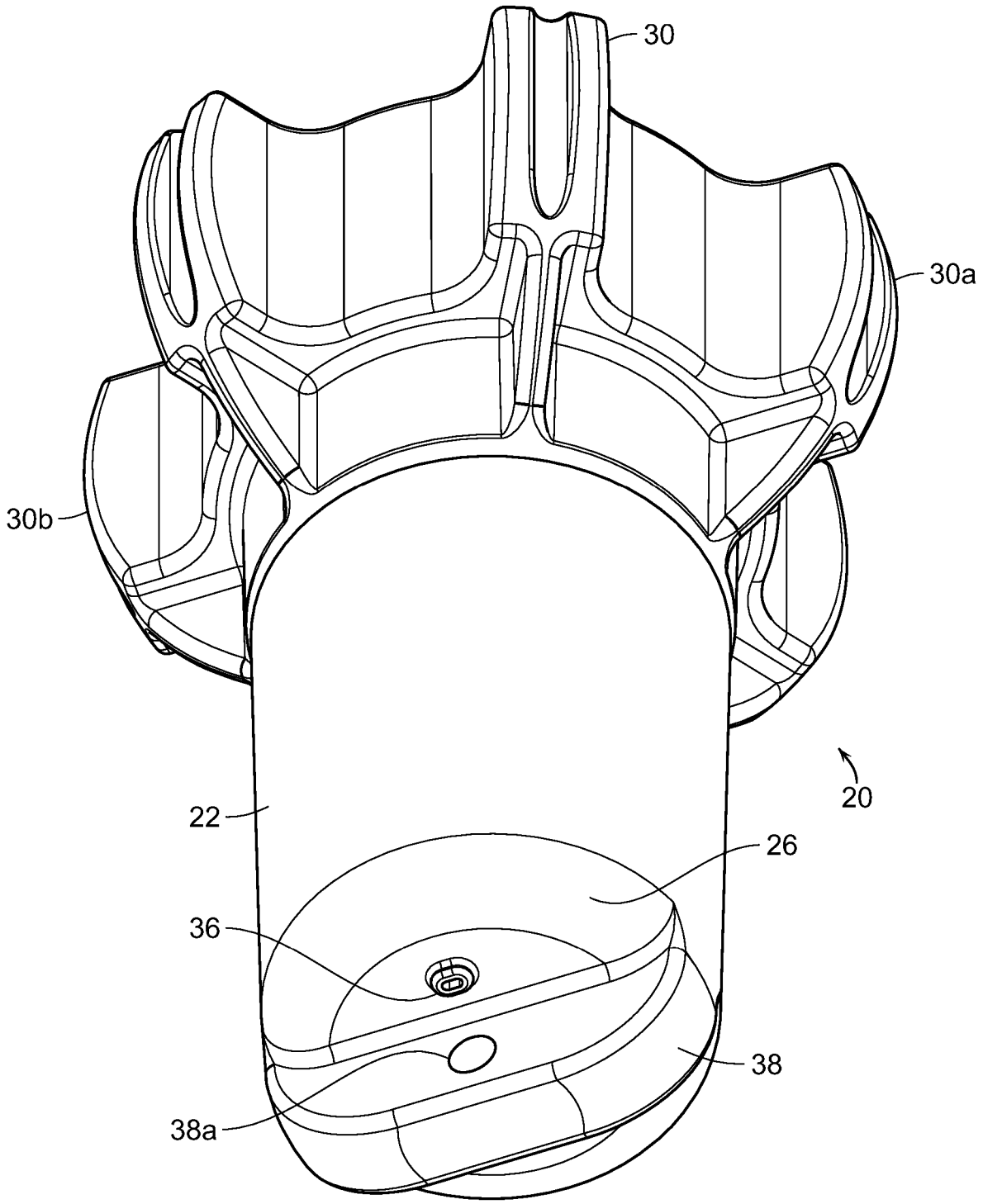
FIG. 4, is a perspective view of the inventive rubberized light housing from the reverse angle of FIG. 3.
Figure 5:
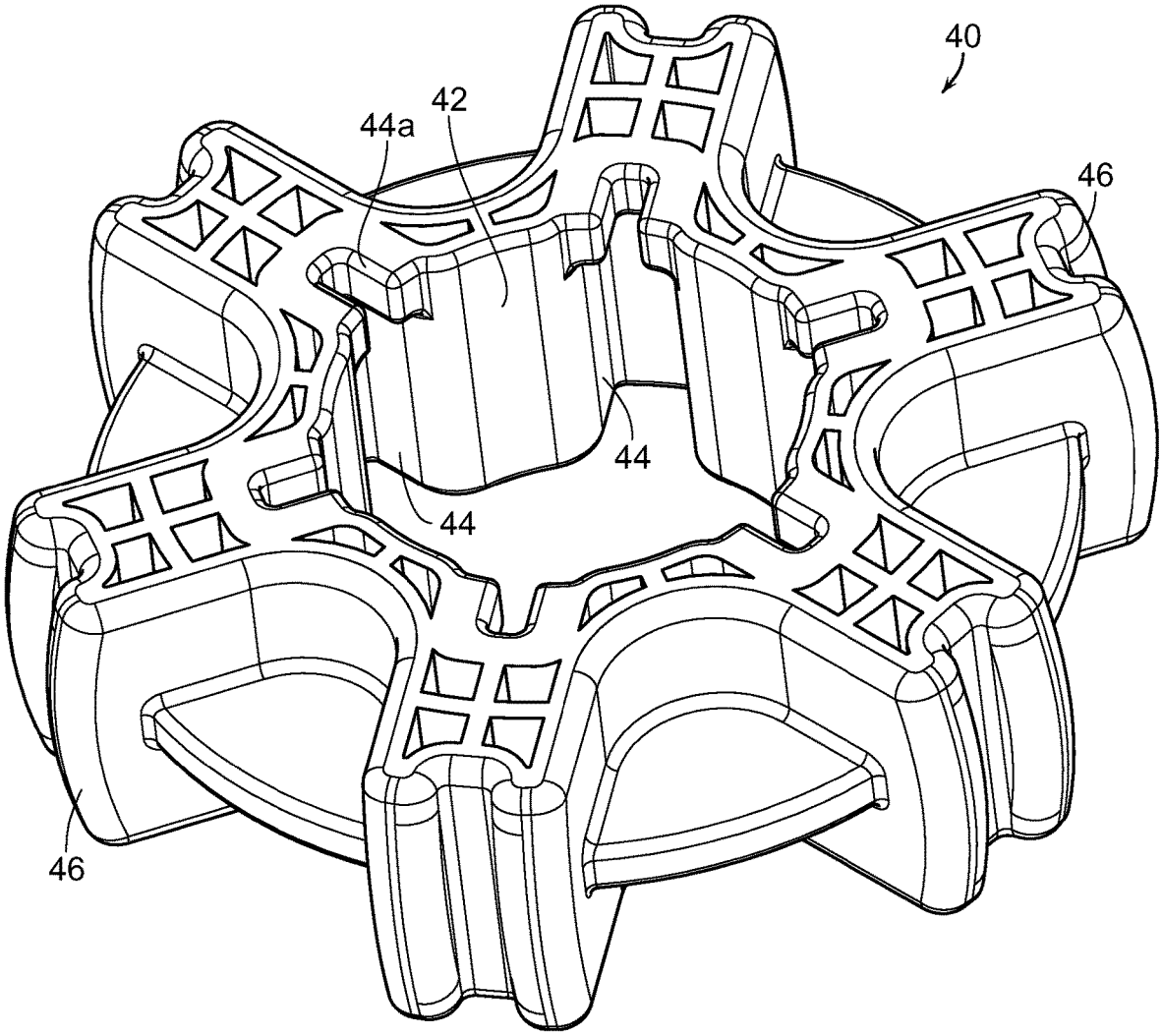
FIG. 5 is a perspective view of the inventive can light adaptor for use with the rubberized light housing.

The present invention is directed to a rubberized light housing and adaptor for use with can lights and similar fixtures. In the following detailed description, the rubberized light housing will be generally referred to by reference numeral 20 and the adaptor by reference numeral 40. FIGS. 3-5 generally show the rubberized light housing 20 from multiple angles and the adaptor 40.

Figure 1:
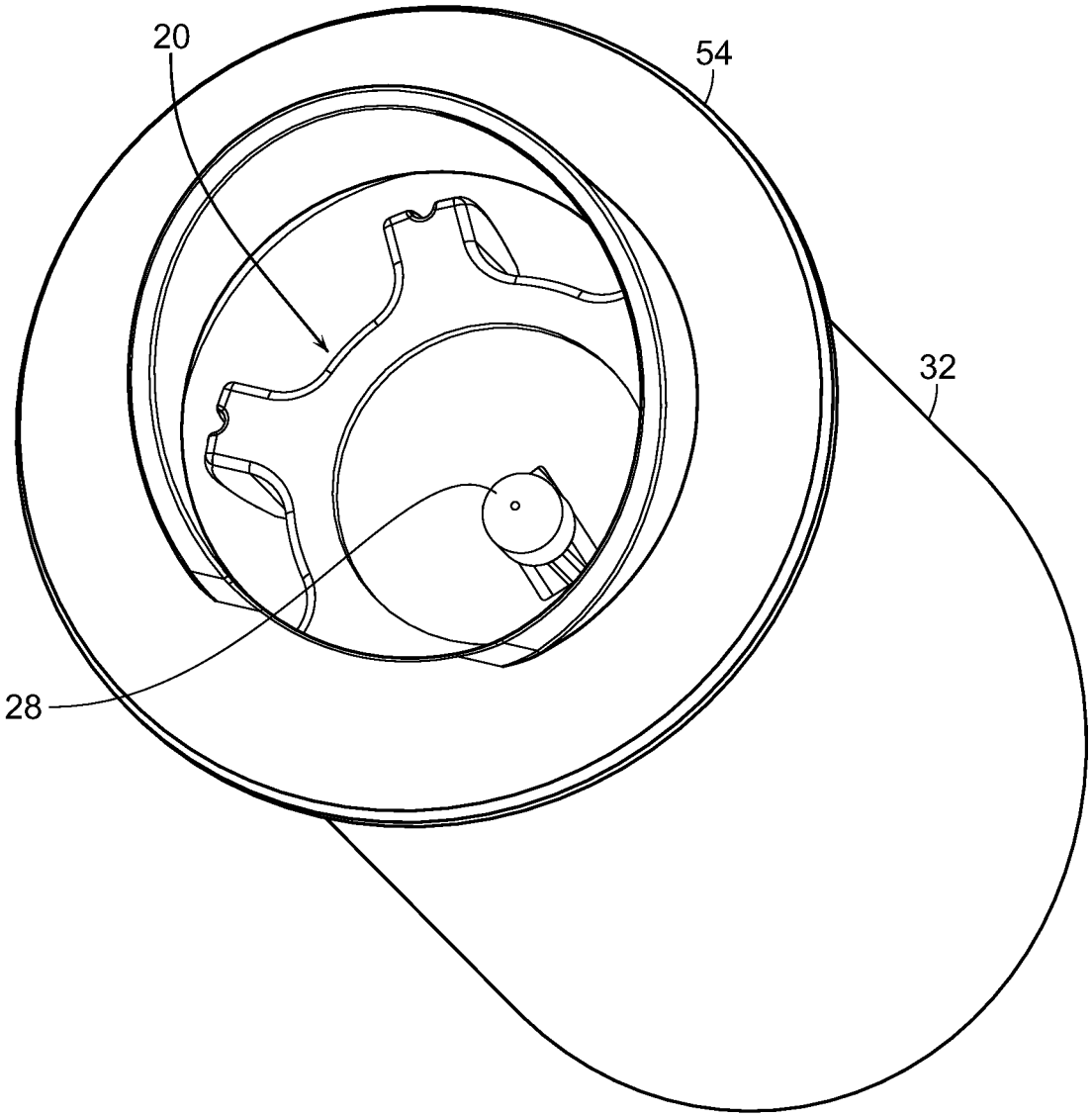
FIG. 1 is a perspective view of a can light and shroud incorporating the inventive rubberized light housing.

With particular reference to FIGS. 3 and 4, the rubberized light housing 20 has a generally tubular elongated body 22 having an open top end 24 and a closed bottom end 26. The elongated body 22 and open top end 24 are generally sized to accommodate and closely match an MR-16 or similarly sized light bulb 28 (FIG. 1) having a generally parabolic reflector body. The size of the body on the bulb 28 is preferably configured to closely match the interior diameter or circumference of the body 22 or open end 24. The rubberized construction of the housing 20 allows for flexibility and durability of the housing when installed in desired locations.

When the bulb 28 is enclosed with an integral lens or similar cover, an annular edge of the bulb 28 may fit in a channel 24*a* around the interior of the open end 24 of the housing 20. If the bulb 28 is not so enclosed, then an annular edge of the bulb 28 may fit into a second channel (not shown) around the interior of the open end 24 and the invention may include a separate lens (not shown) that fits into the channel 24*a*. The purpose of the annular edge of the bulb 28 or separate lens fitting to the channel 24*a* is to provide a substantially water-tight seal to the open end 24 when the bulb 28 is installed. With the water-tight seal, a bulb installed in the housing 20 will be protected against intrusion by water or other moisture.

The bulb 28 may be any known type of illumination device, incandescent, low-voltage, halogen, LED, or similarly known or to be discovered illumination device. Alternatively, the bulb 28 may be replaced with any similar electrical apparatus that one may need to secure in a water-tight housing as described below.

Figure 2:
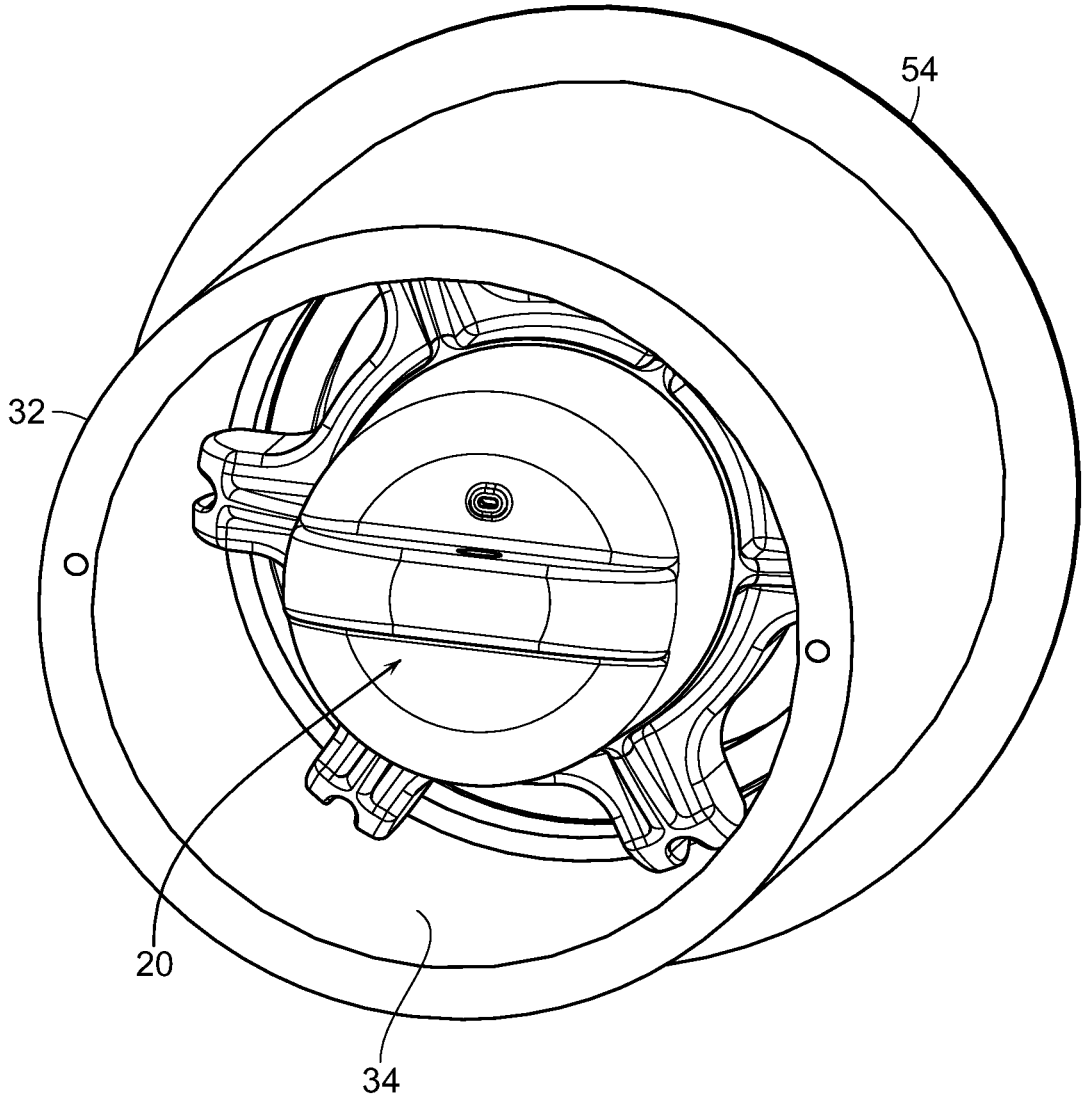
FIG. 2 is perspective view of the can light and shroud from the reverse angle of FIG. 1.

An exterior surface of the open end 24 of the housing 20 is surrounded by a plurality of uniformly spaced ribs 30. The ribs 30 are designed to extend radially away from the body 22 so as to make contact with a surrounding can 32 (FIGS. 1 and 2) or similar light fixture enclosure. The ribs 30 may be provided in various quantities and arrangements intended to exert sufficient force against an interior wall 34 of the can 32 so as to reliably maintain positioning within the can 32. The ribs 30 are preferably resiliently flexible so as to compress sufficiently to allow the housing 20 to fit within an interior of the can 32 with various amount of deflection and return force. Since the ribs 32 are rubberized like the rest of the housing 20, the ribs 30 may be cut or trimmed as needed to allow the housing 20 to fit into a smaller sized can 32.

The ribs 30 may be provided in odd (3, 5, etc.) or even (2, 4, 6, etc.) quantities, being uniformly spaced around the perimeter of the housing 20. In the case of an even number of ribs 30, the ribs are preferably arranged in opposed pairs 30*a*, 30*b* so as to provide an opposed exertion of force across the opposed pairs 30*a*, 30*b*. Such opposed exertion of force provides a more reliably secure positioning of the housing 20 in the can 32. Preferably, the housing 20 includes at least three ribs 30 to provide a uniform exertion of force against the interior wall 34 at least every one-hundred-twenty degrees around the perimeter of the housing 20. Most preferably, the housing includes at least four ribs 30, to provide an exertion of force against the interior wall 34 at least every ninety degrees with the force being an opposed exertion of force every one-hundred-eighty degrees around the perimeter of the housing 20. Ideally, the housing 20 includes six ribs 30 to provide an exertion of force against the interior wall 34 at least every sixty degrees, with the force being an opposed exertion of force every one-hundred-twenty degrees around the perimeter of the housing 20.

The closed bottom 26 of the housing 20 is preferably completely sealed so as to be water-tight. The closed bottom 26 may include a self-sealing port 36 that includes an interior diaphragm (not shown) or similar structure that seals against the passage of water but may selectively allow the passage of wires (not shown) or a similar electrical transmission apparatus. The diaphragm is preferably resiliently configured so as to provide a water-tight seal around any wire or apparatus that is passed through the port 36. The wire or other apparatus passed through the port 36 is designed to transmit electrical current to a bulb 28 or other electrical device contained within the housing 20.

The bottom end 26 of the housing 20 may also include an exterior support 38 or similar structure that includes a hole 38*a* configured to provide a place to attach the housing 20 to a hook, nail or other environmental support (not shown). The exterior support 38 and hole 38*a* are used when the housing 20 is not mounted in a can 32 or can be used as additional support for holding the housing 20 in a fixed position within the can 32.

The inventive apparatus may also include an adaptor 40 that is generally circular in configuration and has a central opening 42 configured to receive the body 22 of the housing 20. The central opening 42 preferably has a number of slots 44 corresponding to the number of ribs 30 on the housing 20. The ribs 30 of the housing 20 are configured to fit in a tight manner within the slots 44 such that the adaptor 40 is effectively an extension of the housing 20. The slots 44 preferably have an end 44*a* that is substantially blocked or closed so that the ribs 30 do not pass all of the way through. The ribs 30 preferably rest against the blocked ends 44*a* of the slots 44 so as to engage the adaptor 40 rather than pass completely through.

The exterior perimeter of the adaptor 40 includes a number of larger ribs 46 spaced and configured using similar considerations as discussed above in connection with the ribs 30. Ideally, the larger ribs 46 are equal in number and configuration as the ribs 30 of the housing 20. As with the housing 20 and ribs 30, the adaptor 40 and larger ribs 46 are preferably rubberized and flexibly resilient. Given their larger diameter, the adaptor 40 and larger ribs 46 are preferably less flexible than the housing 20 and ribs 30 to minimize an undesired collapse of the same.

Figure 6:
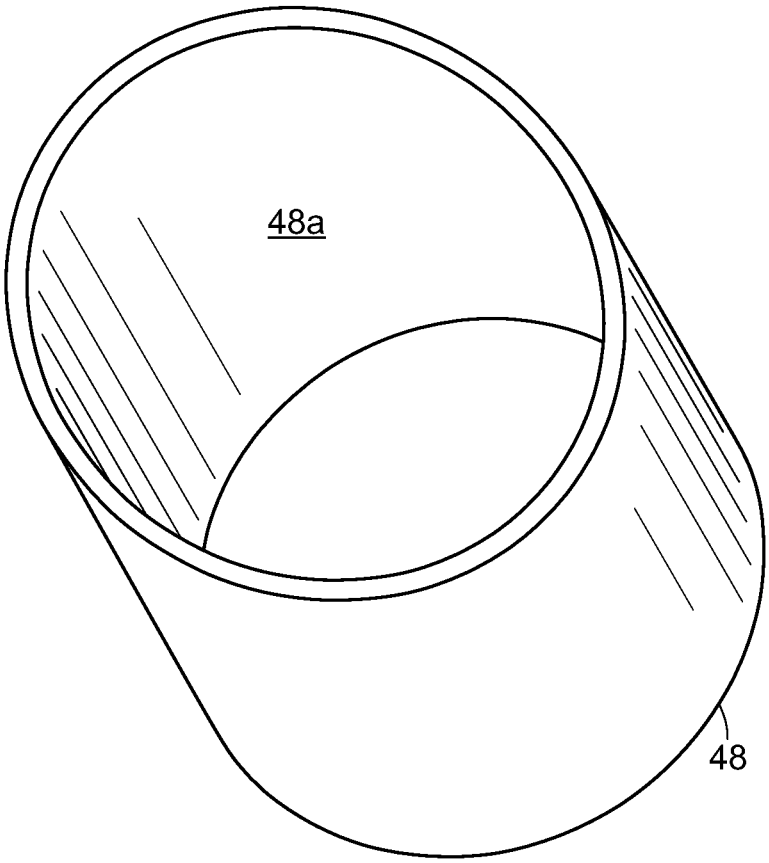
FIG. 6 is a perspective view of a common can light housing.
Figure 7:
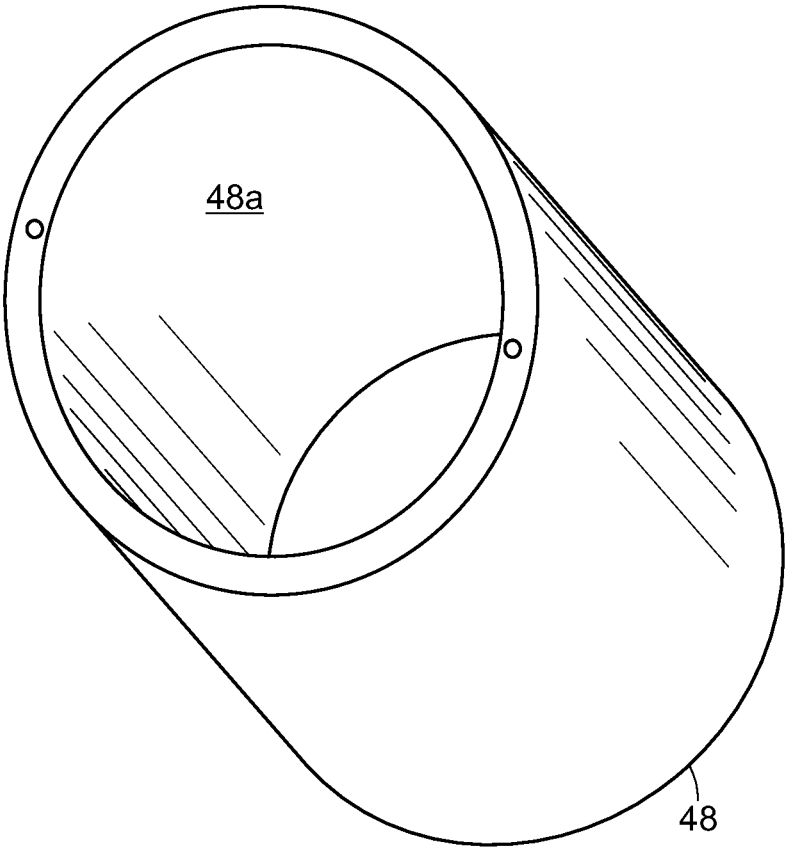
FIG. 7 is a perspective view of a common can light housing from the reverse angle of FIG. 6.

The adaptor 40 is intended to allow the rubberized light housing 20 to be used with larger cans 48 (FIGS. 6 and 7) having a diameter that is too large for just the ribs 30 of the housing 20. The larger ribs 46 on the adaptor 40 provide a wider reach to an interior wall 48*a* in a larger can 48. On original installations, a person may be able to use a can 32 that is appropriately sized for the ribs 30 of the housing 20. However, in retrofit installations, the larger can 48 may be already installed and it is much simpler to use the adaptor 40 having the larger ribs 46 with the housing 20 rather than to remove and replace the larger can 48 with a smaller can 32.

Figure 8:
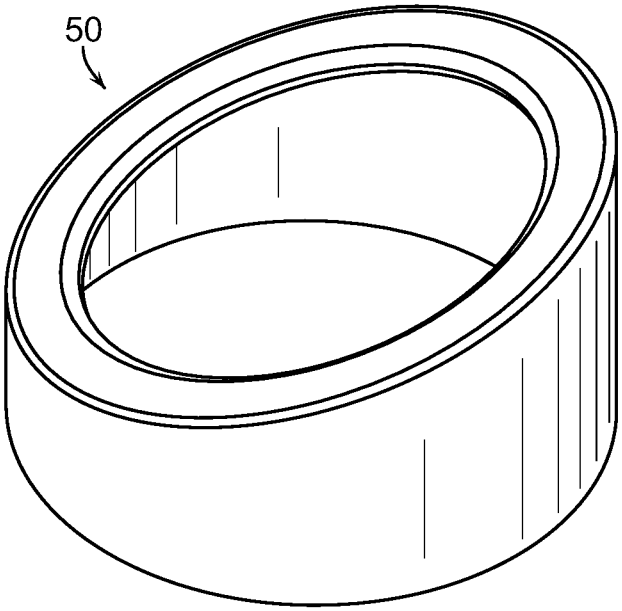
FIG. 8 is a perspective view of a common cap for a can light housing.
Figure 9:
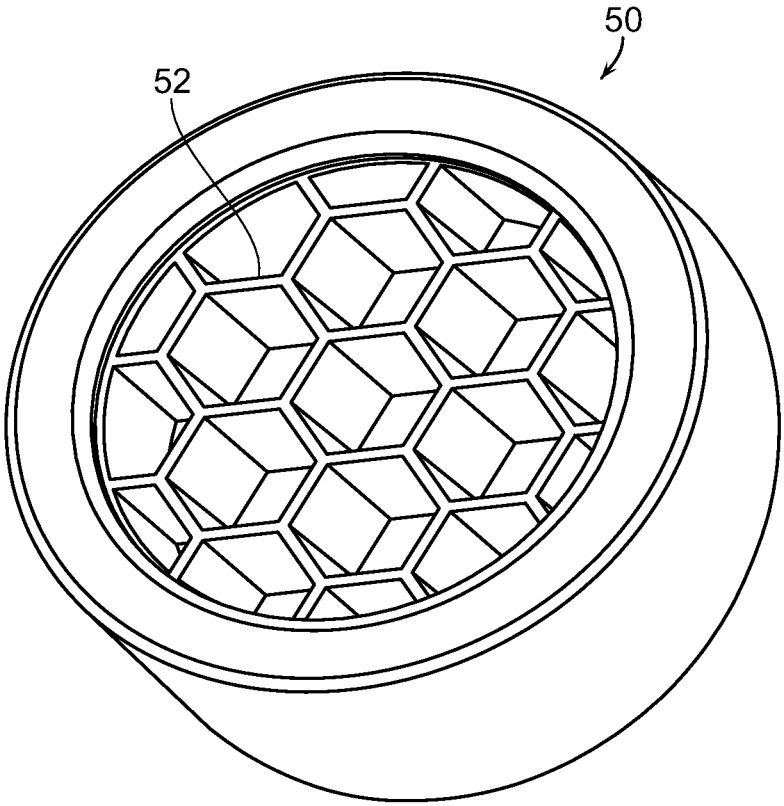
FIG. 9 is a perspective view of a common shroud and honeycomb louver for a can light housing.
Figure 10:
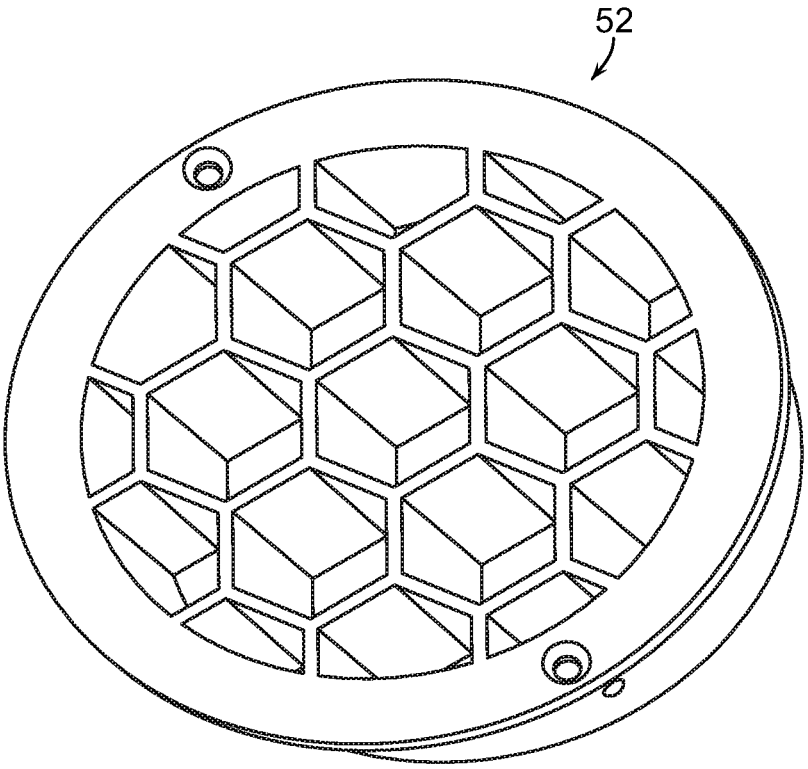
FIG. 10 is a perspective view of a honeycomb louver for a can light.

FIGS. 8-13 illustrate various forms of shrouds and louvers for use with the cans 32, 48 that accommodate the housing 20 and/or adaptor 40. In FIG. 8, a common cap 50 for a can light 32, 48 is shown. The common cap 50 generally matches the shape of the can light 32, 48 in that it is configured to fit around the can 32, 48 as a sleeve. The cap 50 may have a lens (not shown in FIG. 8) or other insert. As illustrated, the cap 50 may also have a slight tilt or angle to provide some directional illumination. In FIG. 9, a cap 50 is shown including a honeycomb louver 52. FIG. 10 illustrates the honeycomb louver 52 separate from the cap 50.

Figure 11:
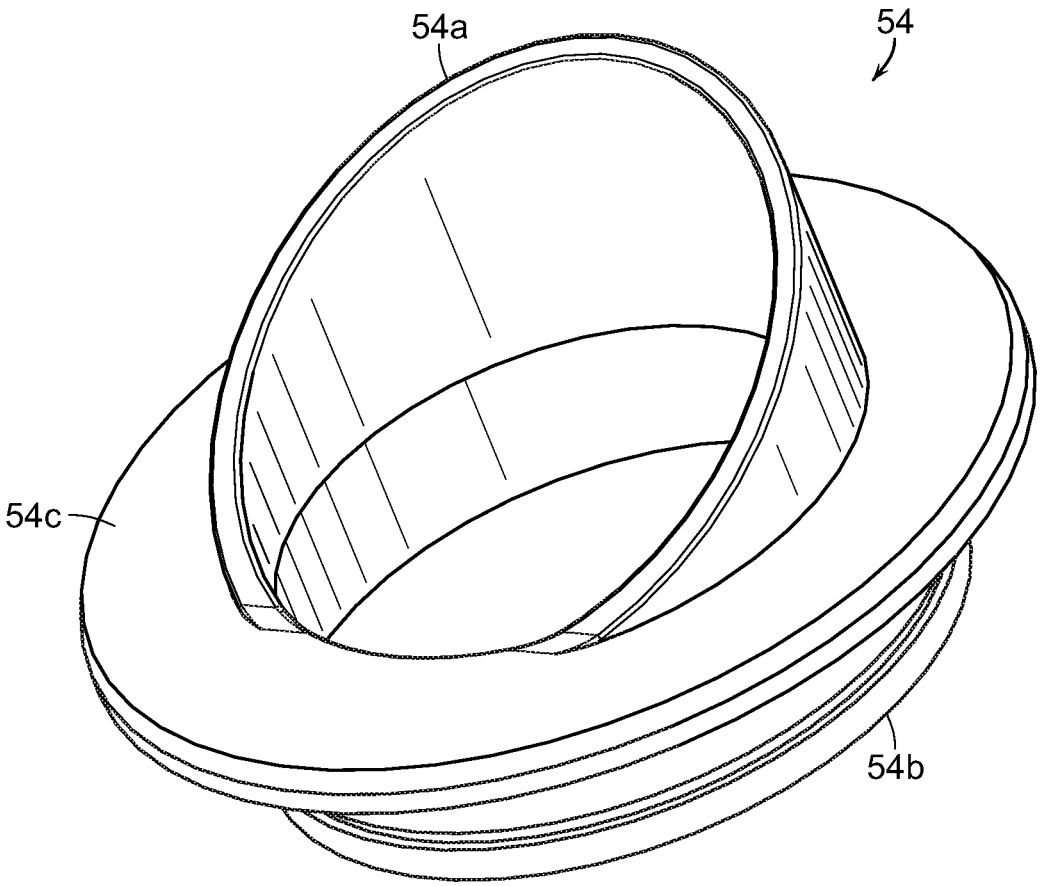
FIG. 11 is a perspective view of a common angle shroud for a can light housing.
Figure 12:
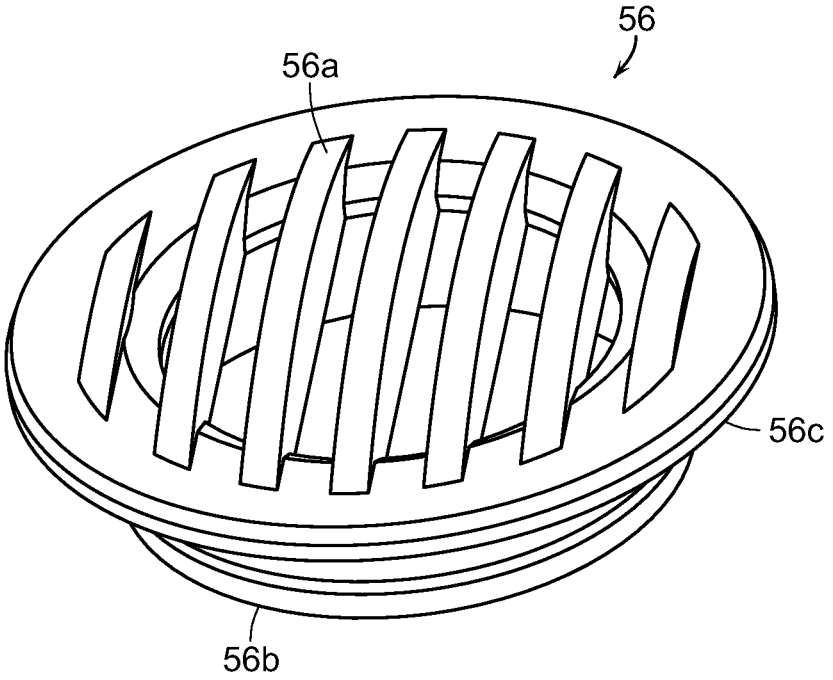
FIG. 12 is a perspective view of a common grated shroud for a can light housing.
Figure 13:
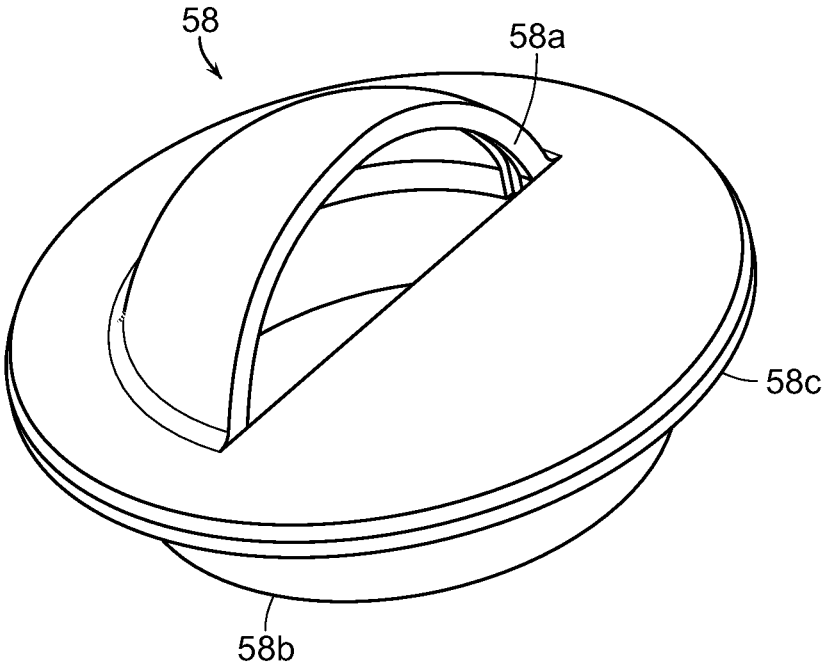
FIG. 13 is a perspective view of common eyelid shroud for a can light housing.

FIG. 11 illustrates an angle shroud 54 that has an angled wall 54*a* to direct illumination from light source and has a base 54*b* that is designed to fit inside of the can 32, 48 to retain the angle shroud 54 on the fixture. An annular ring 54*c* surrounds the angle shroud 54 to overhand the edge of the can 32, 48. FIG. 12 illustrates a grated shroud 56 having a plurality of grates 56*a*, a base 56*b*, and an annular ring 56*c*, as described with the angle shroud 54. FIG. 13 illustrates and eyelid shroud 58 having a crescent opening 58*a*, a base 58*b*, and an annular ring 58*c*. Such caps, louvers and shrouds are designed to diffuse or direct the light source as desired.

Although several embodiments have been described in detail for purposes of illustration, various modifications may be made without departing from the scope and spirit of the invention.

What is claimed is:

1. A light housing, comprising:

an elongated body having a generally tubular shape with an open first end and a closed second end, wherein the first end is configured to receive and retain a light bulb proximate to the first end;

a sealing port in the second end, wherein the sealing port is configured to hermetically seal against electrical wires passed into an interior of the elongated body;

and at least three longitudinal ribs uniformly spaced at most every one-hundred-twenty degrees around a perimeter of the first end of the elongated body, wherein the longitudinal ribs are resiliently flexible and configured for friction contact with an interior of a lighting can housing.

2. The light housing of claim 1, wherein the first end sealingly receives and retains the light bulb so as to hermetically seal the interior of the elongated body.

3. The light housing of claim 1, further comprising a lens sealingly disposed in a lens channel proximate the open first end so as to hermetically seal the interior of the elongated body.

4. The light housing of claim 1, further comprising a transverse support rib disposed on the closed second end of the elongated body.

5. The light housing of claim 1, wherein the longitudinal ribs comprise at least four longitudinal ribs uniformly spaced at most every ninety degrees around the perimeter of the first end of the elongated body.

6. The light housing of claim 1, wherein at least one of longitudinal ribs is configured to be cut so as to reduce a span of the longitudinal ribs relative to the interior of the lighting can housing.

7. The light housing of claim 1, wherein the elongated body, sealing port, and longitudinal ribs are all manufactured from a rubber material.

8. A light housing, comprising:

an elongated body having a generally tubular shape with an open first end and a closed second end, wherein the first end is configured to receive and retain a light bulb proximate to the first end;

a sealing port in the second end, wherein the sealing port is configured to hermetically seal against electrical wires passed into an interior of the elongated body;

a plurality of ribs uniformly spaced around a perimeter of the first end of the elongated body; and an adaptor ring having a plurality of larger ribs uniformly spaced around a perimeter thereof, wherein the adaptor ring is configured for concentric engagement with the plurality of ribs on the first end of the elongated body.

9. The light housing of claim 8, wherein the adaptor ring is configured to enlarge a span of the plurality of ribs.

10. The light housing of claim 8, wherein the adaptor ring is resiliently flexible and configured for friction contact with an interior of a larger lighting can.

11. The light housing of claim 8, further comprising a lens sealingly disposed in a lens channel proximate the open first end so as to hermetically seal the interior of the elongated body.

12. The light housing of claim 8, wherein at least one of the plurality of larger ribs on the adaptor ring is configured to be cut so as to reduce a span of the larger ribs relative to an interior of a larger lighting can housing.

13. The light housing of claim 8, wherein the elongated body, sealing port, plurality of ribs, and adaptor ring are all manufactured from a rubber material.

14. A light housing, comprising:

an elongated body having a generally tubular shape with an open first end and a closed second end, wherein the first end is configured to receive and retain proximate to the first end a light bulb having a generally parabolic reflector body, wherein the first end sealingly receives and retains the parabolic reflector body of the light bulb so as to hermetically seal an interior of the elongated body;

a self-sealing port in the second end, wherein the sealing port is configured to hermetically seal against electrical wires passed into the interior of the elongated body;

and a plurality of ribs uniformly spaced around a perimeter of the first end of the elongated body.

15. The light housing of claim 14, further comprising a lens sealingly disposed in a lens channel proximate the open first end so as to hermetically seal the interior of the elongated body.

16. The light housing of claim 14, further comprising a transverse support rib disposed on the closed second end of the elongated body.

17. The light housing of claim 14, wherein at least one of the plurality of ribs are capable of being cut so as to reduce a span of the plurality of ribs.

18. The light housing of claim 14, wherein the elongated body, self-sealing port, and plurality of ribs are all manufactured from a rubber material.

* * * * *